United States Patent [19]

Edgar et al.

[11] Patent Number: 5,050,365

[45] Date of Patent: Sep. 24, 1991

[54] CONCRETE FORM SNAP TIE

[75] Inventors: Roy L. Edgar, Springboro; Joseph N. Young, Centerville, both of Ohio

[73] Assignee: Dayton Superior Corporation, Miamisburg, Ohio

[21] Appl. No.: 556,137

[22] Filed: Jul. 23, 1990

[51] Int. Cl.[5] ..... E04B 1/38

[52] U.S. Cl. ..... 52/713; 52/712; 249/41; 249/46

[58] Field of Search ..... 249/41, 46, 213, 214, 249/216, 217, 219.1, 219.2; 52/712, 713

[56] References Cited

U.S. PATENT DOCUMENTS 2,049,916 8/1936 Lingle ..... 249/217
2,054,258 10/1977 Holmboe ..... 249/217 X
3,013,323 12/1961 Williams ..... 249/217
3,260,495 7/1966 Buyken ..... 249/41 X

OTHER PUBLICATIONS

Dayton Snap in Ties Product Literature, 2/8/1939.

*Primary Examiner*—Michael Safavi
*Attorney, Agent, or Firm*—Biebel & French

[57] ABSTRACT

A snap tie for use in maintaining a predetermined spaced relation between opposed forms prior to and during the pouring of a concrete wall therebetween comprises a steel rod of predetermined uniform cylindrical section having at each end an integrally formed head of substantially larger cross sectional dimensions. The rod also includes a portion interconnecting the inner side of each head with the remainder of the rod which has cross sectional dimensions intermediate those of the heads and of the remainder of the rod.

5 Claims, 2 Drawing Sheets

CONCRETE FORM SNAP TIE

BACKGROUND OF THE INVENTION

This invention relates to ties for use in maintaining a predetermined spaced relation between opposed forms prior to and during the pouring of a concrete wall therebetween. The invention is particularly concerned with "snap ties" which are designed to have their outer end portions broken off inside the wall after the concrete has set and the forms have been removed.

In the conventional use of snap ties, each tie has a shoulder or other spacer adjacent each end thereof which butts the inner surface of a form. The remainder of the tie passes through a hole in the form and has a head on its outer end which cooperates with clamping means and reinforcing lumber ("wales") to brace the assembled forms against the internal hydraulic pressure developed while the concrete suspension fills the space between the forms.

The present invention is concerned with a problem affecting the utility of snap ties of conventional construction which arises from the fact that during erection of the form and their reinforcing lumber, the mechanical connection between the head of each tie and the adjacent wale is provided by a wedge designed to apply tension to the end portion of each rod between each head and the spacer which engages the inner face of the adjacent form.

The problem to which the invention is directed is that with conventional ties and associated parts, instead of maintaining essentially axially directed tension on these end portions of each rod, forces are developed which apply a twisting force to one or both of the rod heads in the area where they interconnect with the remainder of the rod. These forces are often so severe as to cause the head of the rod to snap off prematurely, thereby reducing the holding force on the forms and making it possible for them to move apart, and thus to produce a wall of non-uniform thickness.

SUMMARY OF THE INVENTION

According to the present invention, the problem and effect on conventional ties as outlined above are eliminated by a novel construction of each tie wherein the portion of the tie where each head interconnects with the remainder of the rod is of larger cross sectional dimensions than the remainder of the rod, although less than those of the head, and thereby reinforce the interconnection between the head and the remainder of the rod sufficiently to overcome any tendency to premature snapping of the tie in this area.

The novel structure of the ties of the invention and the manner in which they overcome the problems of prior art are explained in greater detail in the description of the preferred embodiment of the invention which follows.

DESCRIPTION OF THE PREFERRED EMBODIMENT

Figure 1:
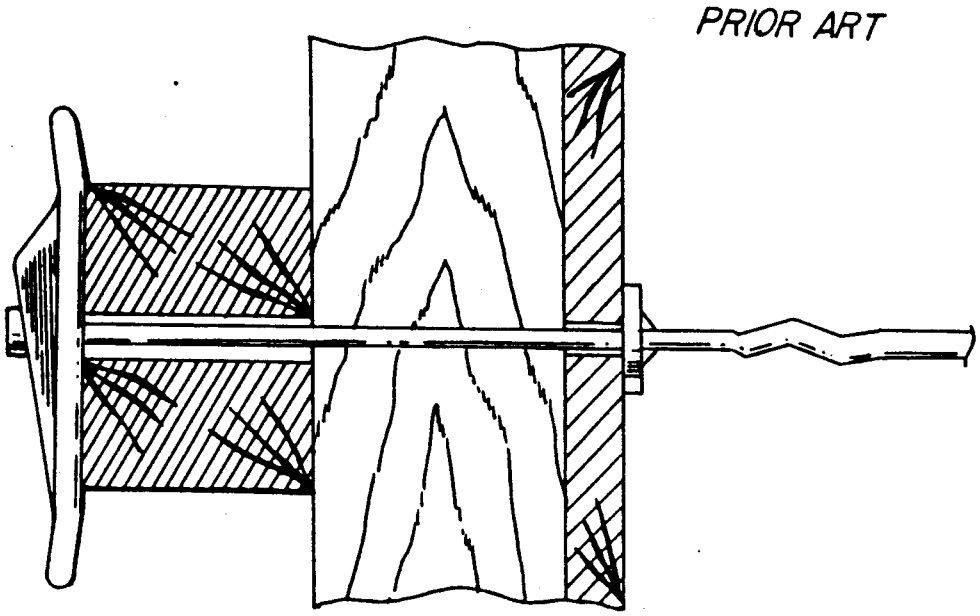
FIG. 1 is a fragmentary section through one side of erected formwork which includes a snap tie, wedge and reinforcing lumber according to conventional prior practice.
Figure 2:
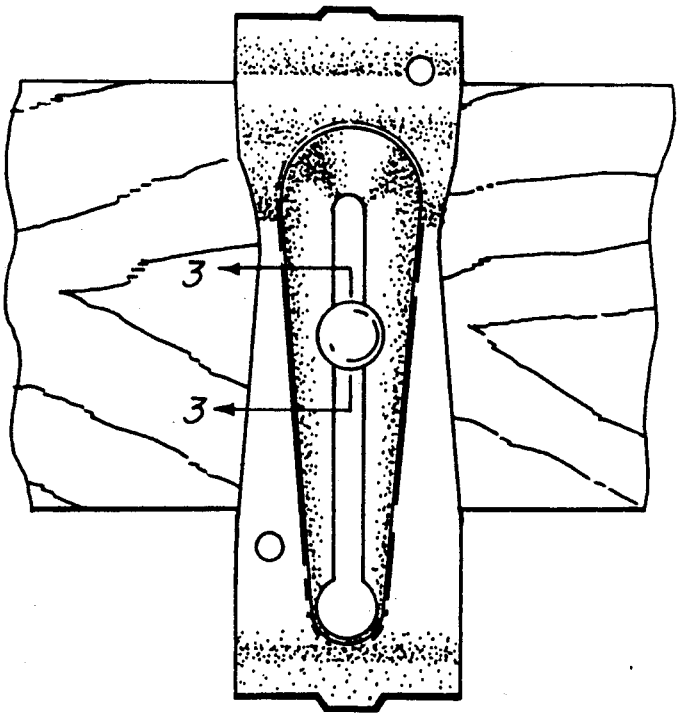
FIG. 2 is an elevation looking from left to right in FIG. 1.
Figure 3:
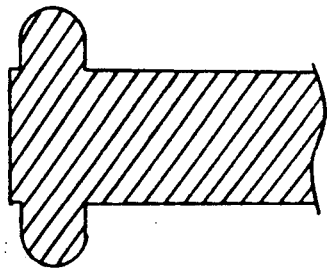
FIG-3 PRIOR ART
FIG. 3 is a fragmentary section on the line 3—3 of FIG. 2 illustrating the head end portion of the conventional tie shown in FIG. 1.

The conventional steel rod tie 10 illustrated in FIGS. 1—3 has a weakened portion 11 where it is intended to be snapped after the wall has been completed, and which is inboard of the spacer 12 that abuts the inner surface of the form 13 in the assembled formwork. The remainder of the rod outboard of the spacer 12 has a head 15 which cooperates with a wedge 20 to clamp the reinforcing wales 21 and 22 against the outer face of the form 13, and this structure is duplicated at the other end of the tie and its formwork associated therewith.

The wedge 20 is of a conventional construction formed of sheet steel of appropriate thickness, e.g. ¼ inch, and having a raised central portion 24 provided with a bayonet slot 25 slightly wider than the cross section of tie 10 and which includes at one end an enlarged portion 26 of sufficient size to receive the rod head 15 freely therethrough. In the use of this wedge, after it has been slipped over the head of the rod, it is driven lengthwise of slot 25 while the rod head 15 climbs the sides of the slot to develop the desired tension and interlocking of the several parts of the formwork during this assembly action, the sloping sides of the wedge slot 25 will initially tend to cause the head of the tie to bend away from the direction of its travel in the slot 25, i.e. downwardly as viewed in FIGS. 1 and 2.

Thereafter, when the assembly of multiple ties and wedges is required to hold the forms against the hydraulic pressure of the fluid concrete filling the space between the forms, the tension on the ties and the pressure on the wedges greatly increase. It has been found in practice that on too many occasions, the wedge tends to collapse to some extent, and usually to a greater extent on the one side of the slot 25 than the other. Whenever this occurs, a new force will be applied to the head end of the tie, tending to cause it to bend at right angles to the bend initially imparted thereto during assembly of the formwork. The end result is a tendency of the rod head to snap off prematurely, with resulting undesirable effects on the uniformity of the concrete wall.

Figure 4:
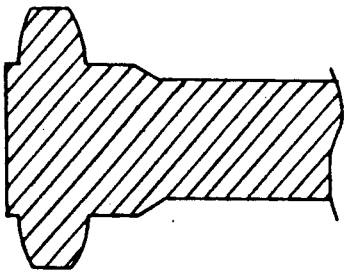
FIG. 4 is a view similar to FIG. 3 illustrating the head end portion of a tie in accordance with the present invention.
Figure 5:
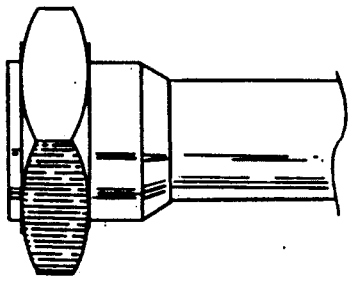
FIG. 5 shows the same portion of the tie as FIG. 4 in side elevation.

A tie rod 30 developed in accordance with the invention as illustrated in FIGS. 4–5 successfully overcomes these problems. Except for its end portions, the tie 30 may be identical with the tie 10 and include a similar break back and also a head 33 at each end, which is shown as hexagonal but may be of any other polygonal shape or of cylindrical cross section.

It is in the junction between the head 33 at each end of the rod and the adjacent main portion 30 of the rod that the tie of the invention differs from the prior art and thereby solves the problem outlined above. More specifically, the tie includes a portion 35 interconnecting the head 33 and the body of the rod which is cylindrical in cross section but of a diameter which varies from its inner end where it blends into the remainder of the rod to a maximum where it blends into the head 33, the latter junction preferably being curved about a radius as shown at 36 in FIG. 4.

As an example of dimensions which have been found satisfactory, where the body of the rod is 0.223 inch in diameter, the portion 25 may be 0.250 inch in diameter over the major part of its length, while its outer end is curved about a radius of at least 0.06 inch. This intermediate portion 35 should be of at least sufficient axial length to provide adequate strengthening of the junction between the head 33 and the remainder of the rod, and tests indicate that this dimension should be at least 0.078 inch where the axial dimension of the head 33 is 0.125 inch. The axial dimension of the portion 35 may be greater, but to the extent that it is significantly greater than an established acceptable minimum as stated above, it would represent excess material and therefore unnecessary cost.

Ties in accordance with the invention as described above are readily fabricated by the method and apparatus disclosed and claimed in co-owned Wolfe et al U.S. Pat. No. 4,473,738, by hot forging the end and interconnecting portion at each end of an appropriate length of rod, utilizing a die having a cavity shaped to correspond with the profile of the rod end illustrated in FIG. 5. It will be understood that the peripheral contour of each tie end is not critical to the invention, but the polygonal contour illustrated in FIGS. 4 and 5 is preferred because of the combined advantages which it offers of ease in snapping the tie and minimum waste in the portions of each tie removed by snapping.

While the article herein described constitutes a preferred embodiment of the invention, it is to be understood that the invention is not limited to this precise article, and that changes may be made therein without departing from the scope of the invention which is defined in the appended claims.

What is claimed is:

1. For use in maintaining a predetermined spaced relation between opposed forms prior to and during the pouring of a concrete wall therebetween, the combination comprising:

(a) a steel rod of predetermined uniform cylindrical section over the major portion of the length thereof, (b) a head of substantially larger diameter than said rod integrally formed on each end of said rod, (c) said rod including a cylindrical shoulder portion adjacent the inner side of each said head which has a diameter intermediate the diameter of said uniform cylindrical section and said heads, and (d) a wedge having an elongated slot therethrough of a predetermined width intermediate said diameters of said shoulder portions of said rod and each said head, (e) whereby upon assembly of said rod in said slot with one said head thereof in engagement with said wedge, the adjacent said shoulder portion of said rod will lie within said slot.

2. A tie as defined in claim 1 wherein as viewed in lengthwise section, the end of said shoulder portion immediately adjacent each said head has an arcuately curved concave outer periphery, and the other end of each said shoulder portion tapers toward the remainder of said rod.

3. A tie as defined in claim 1 wherein said shoulder portion has a dimension measured lengthwise of said rod which is less than the corresponding dimension of each said head and of said slot.

4. A tie as defined in claim 1 wherein each said head has a polygonal peripheral contour.

5. A tie as defined in claim 1 wherein each said head has a polygonal peripheral contour, and as viewed in lengthwise section, the end of said shoulder portion immediately adjacent each said head has an arcuately curved concave outer periphery, and the other end of each said shoulder portion tapers toward the remainder of said rod.

* * * * *